United States Patent [19]

Fansler et al.

[11] Patent Number: 4,928,573

[45] Date of Patent: May 29, 1990

[54] SILENCER FOR SABOTED PROJECTILES

[75] Inventors: Kevin S. Fansler, Harre'de Grace; David H. Lyon, Forest Hill, both of Md.

[73] Assignee: The United States of America as represented by the Secretary of the Army, Washington, D.C.

[21] Appl. No.: 262,656

[22] Filed: Oct. 26, 1988

[51] Int. Cl.[5] ..... F41F 17/12

[52] U.S. Cl. ..... 89/14.4; 181/223

[58] Field of Search ..... 89/14.2, 14.4; 181/223

[56] References Cited

U.S. PATENT DOCUMENTS

| | | | |
|---|---|---|---|
| 658,934 | 10/1900 | Washington et al. | 89/14.4 |
| 958,935 | 5/1910 | Maxim | 89/14.4 |
| 1,000,702 | 8/1911 | Thurler | 89/14.4 |
| 2,101,849 | 12/1937 | Green | 89/14.5 |
| 2,448,382 | 8/1948 | Mason | 89/14.4 |
| 2,468,926 | 5/1949 | Garrett | 89/14.2 |
| 3,138,991 | 6/1964 | Malter | 89/14.3 |
| 3,492,912 | 2/1970 | Ashbrook | 89/14.3 |
| 3,528,336 | 9/1970 | Donner | 89/14.3 |
| 4,576,083 | 3/1986 | Seberger, Jr. | 89/14.4 |

FOREIGN PATENT DOCUMENTS

| | | | |
|---|---|---|---|
| 78742 | 10/1919 | Austria | 89/14.2 |
| 736217 | 6/1943 | Fed. Rep. of Germany | 89/14.2 |
| 8437 | 9/1922 | United Kingdom | 89/14.2 |

OTHER PUBLICATIONS

Fansler and Lyon, "Attenuation of Muzzle Blast Using Configurable Mufflers", Proceedings of the Tenth International Symposium on Ballistics, vol. 1, Oct. 27–29, 1987, San Diego, CA.

*Primary Examiner*—Stephen C. Bentley

*Attorney, Agent, or Firm*—Saul Elbaum; Paul Clohan

[57] ABSTRACT

A silencer and flash suppressor for sabot projectiles, which includes an accumulation chamber having a projectile entrance surrounding and closed by the gun barrel and a projectile exit which is spaced from the projectile entrance by a distance less than the projectile length. The projectile exit is the smallest diameter of an exit cone which is surrounded by an annular portion of the accumulation chamber, which portion may include one or more perforated baffles.

4 Claims, 4 Drawing Sheets

SILENCER FOR SABOTED PROJECTILES

RIGHTS OF THE GOVERNMENT

The invention described herein may be manufactured, used or licensed by and for the United States Government for governmental purposes without the payment to us of any royalty thereon.

BACKGROUND OF THE INVENTION

1. Field of the Invention

In general, the invention relates to a silencer, that is, a device fitted to a gun muzzle that reduces the peak blast overpressure and impulse noise about the gun. In particular, the invention relates to a silencer for attenuating blast overpressure and impulse noise produced by saboted ammunition.

2. Description of the Related Art including Information disclosed under 37 CFR 1.97–1.99

In known silencers, the noise level is attenuated because the peak energy efflux from the silencer projectile exit hole is reduced relative to the peak energy efflux from the gun muzzle. This reduction in the peak energy efflux from the silencer projectile exit hole is commonly accomplished by (1) increasing the internal volume of the silencer, (2) using internal baffling to promote viscous processes, (3) utilizing materials and structures so as to maximize heat transfer from the propellant gases, and (4) minimizing the area of the projectile exit hole.

For example, the silencers described in U.S. Pat. No. 958,935 issued May 24, 1910 to Maxim, U.S. Pat. No. 2,448,382 issued Aug. 31, 1948 to Mason, and U.S. Pat. No. 4,576,083 issued Mar. 18, 1986 to Seberger, Jr. utilize these methods.

Also, in some silencers, such as those described in U.S. Pat. No. 1,000,702 issued Aug. 15, 1911 to Thurler and U.S. Pat. No. 2,101,849 issued Dec. 14, 1937 to Green, portions of the propellant gases are exhausted to the atmosphere through additional openings in the silencer casing rather than through the silencer projectile exit hole, after these gases have been expanded and cooled.

U.S. Pat. No. 3,528,336, issued Sept. 15, 1970 to Donner, describes a muzzle assembly for use at the end of a smooth-bore barrel on firearms such as mortars, grenade launchers and the like which fire smooth-bore fin-stabilized projectiles. The muzzle assembly has the same inner diameter as the gun barrel and serves as an extension of the barrel to guide the projectile. The muzzle assembly includes radial openings therethrough in the form of slots inclined at an acute angle to the direction of flight of the projectile, so that the highly-compressed propellant gases can escape with minimum turbulence before the projectile has emerged from the barrel. While the major purpose of this muzzle assembly is to increase the accuracy and range of the weapon, it also causes a quieter shot.

In conventional silencers for use with unsaboted projectiles, such as that described in the above-referenced U.S. Pat. Nos. 958,935 and 4,576,083, the projectile exit hole is located near the front end of the silencer body, and this exit hole only needs to be large enough for the projectile to pass through with an expected maximum yaw angle. To pass a projectile with a discarding sabot from such a silencer requires a large exit projectile hole. Typically, the saboted projectile is spinning and the sabot components begin separating from the subprojectile at a certain angle immediately after muzzle exit. The sabot components are appreciably separated from the subprojectile at the exit hole of a conventional silencer. The exit area needed to allow the sabot components to pass without interference also results in the production of a larger energy efflux corresponding to the propellant gases passing through the projectile exit hole. This large energy efflux may severely impair the noise reduction performance of the silencer and limit its usefulness. For example, a conventional silencer for the 25 mm M242 cannon with a length of 46 cm would require a 66 mm diameter exit hole for the saboted projectiles while only needing a 28 mm hole for unsaboted ammunition. This necessary increase in exit hole size would result in approximately a 7 dB decrease in noise attenuation.

SUMMARY OF THE INVENTION

Therefore, it is a primary object of the invention to provide a silencer for saboted projectiles.

It is a further object of the invention to provide a silencer for saboted projectiles which also functions as a flash suppressor.

The expansion chamber of the silencer for saboted projectiles described herein has a rear projectile entrance hole into which the gun muzzle extends so that the entrance hole is closed by the gun barrel. For example, the muzzle end of the gun barrel and the silencer chamber wall defining the projectile entrance hole may be threaded so that the silencer can be screwed onto the gun barrel and sealed to it.

The silencer chamber also has a projectile exit hole which is disposed as near as possible to the gun muzzle to reduce its necessary size, yet far enough away to take advantage of the decrease in the energy flux density of the expanding propellant gas with distance from the gun muzzle. Since generally the saboted projectile is spinning and the sabot components begin separating from the subprojectile at a certain angle immediately after muzzle exit, in order to have a projectile exit hole as small as that of a unsaboted projectile, the projectile exit hole should be at a distance from the gun muzzle less than the axial length of the saboted projectile.

To minimize the diameter of the silencer and still provide a large volume silencer chamber, as well as to direct the flow of propellant gas into the expansion chamber with minimum turbulence along the projectile path throughout the chamber, the front portion of the silencer chamber wall is indented to form a truncated projectile exit cone whose smallest diameter is the projectile exit hole, with the front portion of the silencer expansion chamber extending about the exit cone. The exit cone has an angle which is greater that the flight angle from the bore line of the sabot components, so that none of the sabot components will strike the exit cone wall as they separate from the subprojectile. Further, the exit cone may be curved if the trajectories of the sabot components are also curved.

The silencer expansion chamber may contain one or more perforated baffles to induce viscous processes and partially reflect shock waves so that the accumulating chamber peak pressures are reduced compared with a silencer with no perforated baffles, which in turn allows the chamber wall thickness and the mass of the silencer to be minimized.

BRIEF DESCRIPTION OF THE DRAWINGS

The invention will be better understood, and further objects, features, and advantages thereof will become more apparant from the following description of preferred embodiments, taken in conjunction with the accompanying drawings in which.

DESCRIPTION OF THE PREFERRED EMBODIMENTS

Figure 1:
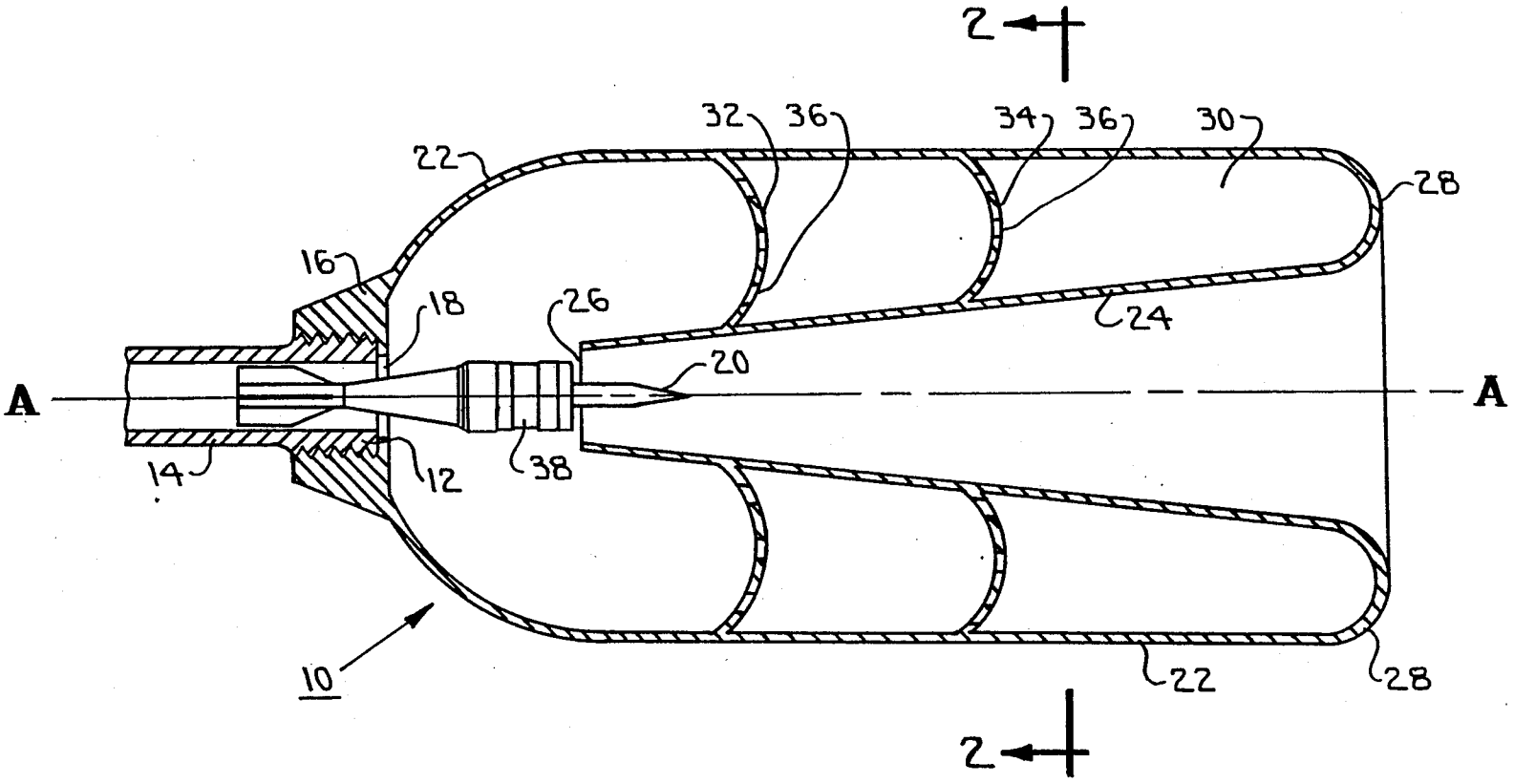
FIG. 1 is a cross sectional side view of a preferred embodiment of the invention, taken along line 1—1 of FIG. 2.
Figure 2:
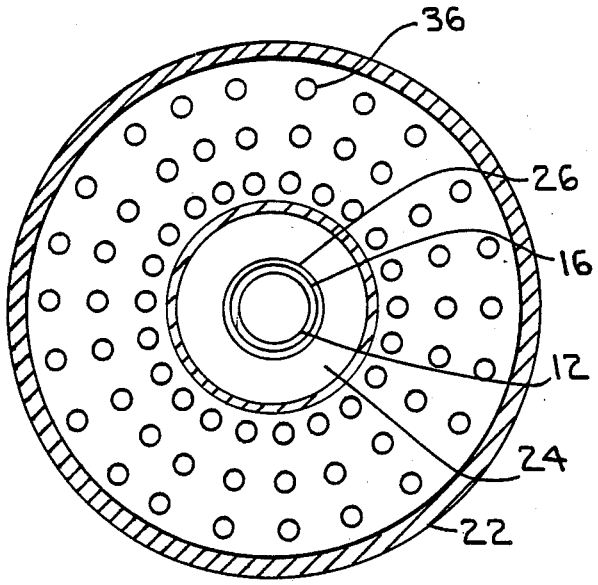
FIG. 2 is a cross sectional radial view of the embodiment of FIG. 1, taken along the line 2—2 of FIG. 1.

Referring to FIGS. 1 and 2, a silencer 10 for saboted projectiles is shown attached to a threaded muzzle 12 of a gun barrel 14 so that it extends symmetrically about the boreline A—A of the gun barrel 14, i.e., the axis of the silencer 10 coincides with the gun barrel axis or boreline A—A. The silencer 10 has a hub 16 having a bore therethrough forming a projectile entrance hole 18 for a saboted projectile 20. The outer portion of the bore 18 is threaded to engage with the threaded gun muzzle 12 and secure the silencer 10 to the gun barrel 14. The periphery of the hub 16 is affixed to an outer shell 22 of the silencer 10.

The silencer 10 includes an exit cone 24 in the form of a truncated cone symmetrically disposed along the axis A—A, with the inner, smallest diameter portion of the cone 24 serving as the projectile exit hole 26 for the saboted projectile 20. At its outer front end, the exit cone 24 is connected to the outer shell 22 by a solid baffle 28, to form therebetween an expansion or accumulation chamber 30 to receive propellant gases when a projectile 20 is fired from the gun. Two annular perforated baffles 32, 34 are disposed within the accumulation chamber 30 between the exit cone 24 and the outer shell 22. Each baffle 32, 34 includes a plurality of perforations or openings 36 therethrough.

The projectile 20, which is shown leaving the gun muzzle 12 and entering the exit cone 24, has several sabot petals 38 which start to separate from the main body of the projectile almost immediately after the projectile leaves the gun muzzle 12. To assure that the diameter of the exit hole 26 can be essentially the same as that required for an unsaboted projectile of the same size, the axial distance between the gun muzzle 12 and the exit hole 26 should be less than the length of the saboted projectile 20.

Many guns used for firing saboted projectiles have standard muzzle brakes, which could be replaced by the silencer 10 described herein. Ideally, the silencer 10 should be no heavier that the muzzle brake it replaces. However, the greater the volume of the silencer accumulation chamber 30, generally the greater the noise attenuation value. Also, a system of perforated baffles for inducing viscous processes and partially reflecting shock waves can be designed so that the accumulation chamber peak pressures are markedly reduced compared to a silencer with no perforated baffles. A properly tailored system of perforated baffles will also reflect pressure waves of an optimum amplitude to avoid high pressure transients at the exit hole 26. With the loads on the silencer 10 reduced, the mass of the structure can be reduced.

Optimum conditions concerning the accumulation chamber size, mass of the silencer, and number and location of perforated baffles can be found by experiment or numerical simulation, as discussed in a paper by the inventors entitled "Attenuation of Muzzle Blast Using Configurable Mufflers", Proceedings of the Tenth International Symposium on Ballistics, Vol. 1, Sponsored by the American Defense Preparedness Association, Oct. 27–29, 1987, San Diego, Calif. Preferrably, the silencer 10 is made of a high strength, corrosion-resistant, metallic material, such as stainless steel.

Figure 3:
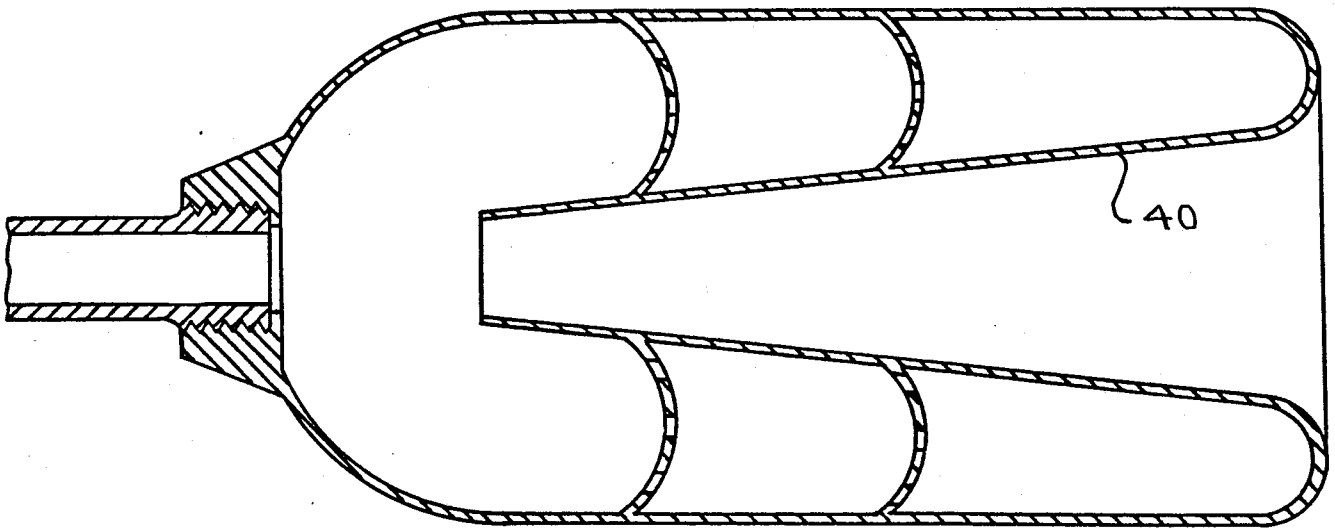
FIGS. 3 and 4 are cross sectional side views of other embodiments of the invention.
Figure 4:
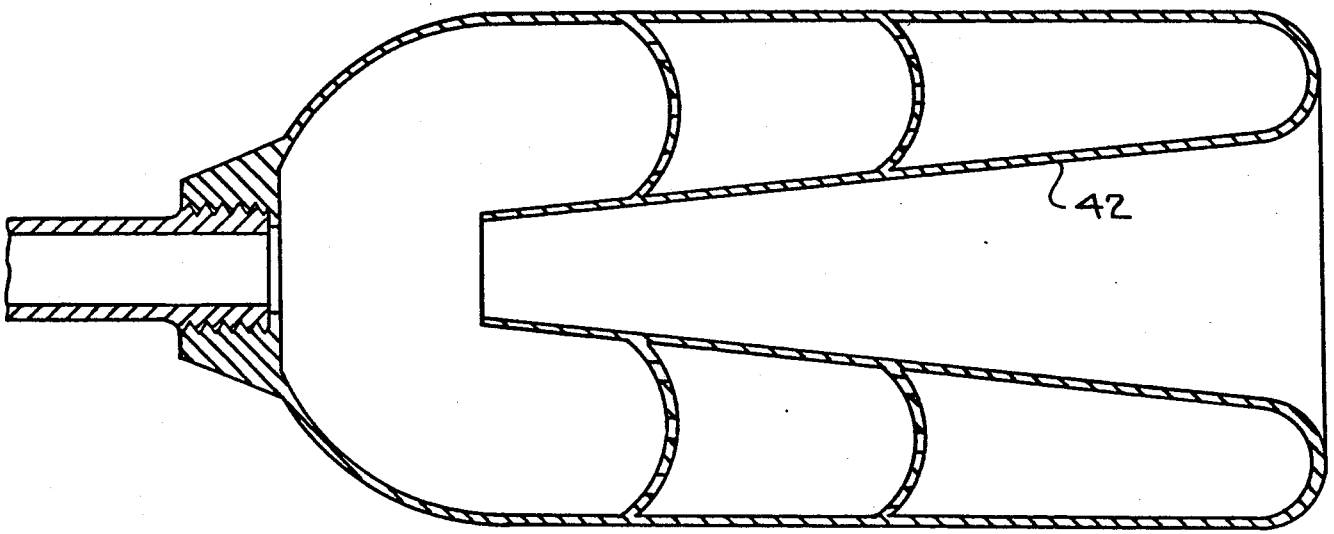

In the preferred embodiment shown in FIGS. 1 and 2, the exit cone 24 is a truncated right circular cone formed by rotating about an axis a portion of a straight line passing through a vertex point on the axis. In alternate embodiments of the invention, the exit cone may be formed by rotating a portion of a curved line about the axis of the cone, to form a flared exit cone 40 such as shown in FIG. 3 or an ogive-shaped exit cone 42 such as shown in FIG. 4., so long as the trajectory of the sabot components are such that these components pass through the exit cone 40 or 42 without intereference. Alternate embodiments such as shown in FIGS. 3 and 4 can be used to better match the shape of the exit cone with the sabot components trajectory, or to improve the performance of the silencer 10 as a flash suppressor.

Since there are many variations, changes, and additions to the invention which would be obvious to a person skilled in the art, it is submitted that the scope of the invention be limited only by the appended claims.

What is claimed and desired to be secured by Letters Patent of the United States is:

1. A silencer for a gun which fires a saboted projectile comprising:

a casing which defines a chamber of the silencer through which the saboted projectile passes when fired from the gun, the chamber having an axis, a rear projectile entrance hole, and a front projectile exit hole, both the entrance hole and the exit hole being disposed on the chamber axis;

means for securing the casing to the gun barrel so that the chamber axis coincides with the gun barrel axis, the gun barrel closes the chamber entrance hole, and the axial distance between the gun muzzle and the exit hole is less than the axial length of the saboted projectile;

wherein the casing defines a truncated exit cone whose smallest diameter is the chamber exit hole, the diameter of the chamber exit hole and shape of the exit cone being selected so that no sabot part will impinge upon the casing as the sabot components separate from the projectile, and the silencer chamber includes an annular front portion surrounding the exit cone;

at least one annular perforated baffle extending around the exit cone in the front portion of the chamber.

2. A silencer, as described in claim 1, wherein the exit cone is formed as a truncated right circular cone.

3. A silencer, as described in claim 1, wherein the exit cone is formed as a truncated flared circular cone.

4. A silencer, as described in claim 1, wherein the exit cone is formed as a truncated ogive-shaped circular cone.

* * * * *